US008549796B2

(12) United States Patent
Heather

(10) Patent No.: US 8,549,796 B2
(45) Date of Patent: Oct. 8, 2013

(54) CONNECTOR SYSTEM FOR BUILDING MODULES

(75) Inventor: David Heather, High Wycombe (GB)

(73) Assignee: Verbus International Limited, London (GB)

( * ) Notice: Subject to any disclaimer, the term of this patent is extended or adjusted under 35 U.S.C. 154(b) by 689 days.

(21) Appl. No.: 12/530,360

(22) PCT Filed: Mar. 7, 2008

(86) PCT No.: PCT/GB2008/000809

§ 371 (c)(1),
(2), (4) Date: Aug. 18, 2010

(87) PCT Pub. No.: WO2008/107693

PCT Pub. Date: Sep. 12, 2008

(65) Prior Publication Data

US 2011/0265396 A1 Nov. 3, 2011

(30) Foreign Application Priority Data

Mar. 8, 2007 (GB) ..... 0704518.0

(51) Int. Cl.
*E04B 1/348* (2006.01)

(52) U.S. Cl.
USPC ..... 52/79.13; 52/79.1; 52/79.2; 52/745.1; 403/292; 403/408.1

(58) Field of Classification Search
USPC ..... 52/79.1, 79.2, 79.9, 79.13, 79.12, 52/106, 234, 236.3, 236.7, 236.9; 403/292, 403/293, 408.1; 410/31, 32, 80
See application file for complete search history.

(56) References Cited

U.S. PATENT DOCUMENTS

| | | | | |
|---|---|---|---|---|
| 3,585,771 | A * | 6/1971 | Pinniger | 52/251 |
| 3,601,866 | A | 8/1971 | Odin | |
| 3,722,714 | A | 3/1973 | Morris et al. | |
| 4,294,185 | A * | 10/1981 | Nordstrom et al. | 114/75 |
| 4,330,970 | A * | 5/1982 | Bonink | 52/125.4 |

FOREIGN PATENT DOCUMENTS

| | | | |
|---|---|---|---|
| DE | 1929421 | A | 12/1969 |
| DE | 88 04 979.5 | U | 8/1988 |
| DE | 298 19 179 | U | 5/1999 |
| GB | 2 439 864 | A | 1/2008 |
| JP | 2000-281174 | A | 10/2000 |
| WO | WO 2005/038155 | A | 4/2005 |
| WO | WO 2005038155 | A1 * | 4/2005 |

* cited by examiner

*Primary Examiner* — William Gilbert
*Assistant Examiner* — Alp Akbasli
(74) *Attorney, Agent, or Firm* — Frommer Lawrence & Haug LLP; Ronald R. Santucci

(57) ABSTRACT

A building includes first and second building modules connected together by a connector system. The connector system comprises a first connector block (51) fixed to the first building module, a second connector block (52) fixed to the second building module, a load bearing fixing plate (63) interposed between the first and second building modules and projecting outwardly therefrom, and a spigot (61) that passes through an opening in the fixing plate (63), projecting on one side of the plate into an opening in the first connector block (51) and projecting on the opposite side of the plate into an opening in the second connector block (52).

24 Claims, 8 Drawing Sheets

CONNECTOR SYSTEM FOR BUILDING MODULES

This application is a 371 of PCT/GB2008/000809 filed on Mar. 7, 2008, published on Sep. 12, 2008 under publication number WO 2008/107693 A which claims priority benefits from British Patent Application Number 0704518.0 filed Mar. 8, 2007, the disclosure of which is hereby incorporated by reference.

This invention relates to a building made from building modules connected together, to building modules and a connector system for connecting the modules together, to a connector system per se and to a method of constructing a building by connecting building modules together.

There have been many prior proposals for constructing buildings from pre-fabricated units. WO 2005038155 describes such a system which offers many advantages and also describes by way of example one kind of connector system that may be employed to connect the modules together. In the connector system of WO 2005038155, building modules of cuboidal shape are provided with hollow blocks at the corners of each module, the blocks having openings through which connector elements can be inserted. In one described example a connector element is formed as a single casting comprising a central load bearing plate part and lugs projecting from opposite sides of the plate part, the lugs being received in openings in the hollow blocks. To secure the blocks, further fastening elements in the form of lockdown plates are then secured to the blocks. If desired, gaskets can be placed on either side of the load bearing plate part, the gaskets having apertures to allow the passage of the lugs therethrough and serving to isolate the acoustic vibration and/or to accommodate movement which might otherwise generate stresses in the building.

In the connector system described in WO 2005038155 the dimensions of the single casting of the connector element determine the spacing of one module from another and other features of the connection. Thus if, for example, a different spacing is required between two building modules, a different connector element has to be cast. The connector system just described is also relatively complex, having several separate parts.

It is an object of the invention to provide an improved connector system.

According to the invention there is provided a building including first and second building modules connected together by a connector system, each of the first and second building modules being hollow and defining a space of a size suitable for occupation by a person, the connector system comprising a first connector block fixed to the first building module, a second connector block fixed to the second building module, a load bearing fixing plate interposed between the first and second building modules and projecting outwardly therefrom, and a spigot that passes through an opening in the fixing plate, projecting on one side of the plate into an opening in the first connector block and projecting on the opposite side of the plate into an opening in the second connector block.

By providing a connector system that includes a spigot and a separate load bearing fixing plate, an especially flexible and economical system can be provided because the nature of the connection can be changed merely by changing the fixing plate, without changing other parts of the system: The building may readily be arranged such that the same spigot is used for each connection.

Preferably the spigot has a relatively wide middle portion that passes through the opening in the fixing plate and reduces in cross-section towards each of its opposite ends. The reduction in cross-section may be irregular but is preferably provided by a taper, which may be of constant angle. The spigot may be of generally rectangle cross-section. The narrower extreme end of the spigot facilitates location of the spigot in the opening of a connector block and the tapered shape then enables the correct location of the connector block relative to the spigot as the spigot is inserted into the connector block.

The spigot serves to secure the first building module relative to the second building module in terms of movement in a direction laterally relative to the spigot. The portions of the spigot immediately inside the openings in the first and second connector blocks are preferably of substantially constant cross-section. Whilst a tapered end portion can facilitate alignment as explained above, by having a non-tapered portion of the spigot engaging the connector block when in its final position, an especially good lateral location of the connector block on the spigot can be provided. Preferably the portions of the spigot of substantially constant cross-section are close fits in the connector blocks. In this respect it should be understood that an interference fit, although not particularly preferred, is to be regarded as a kind of close fit as is a fit which allows a few mm of play. Preferably the spigot includes a middle portion that is of too big a cross-section to be inserted into the openings in the first or the second connector blocks. The middle portion is preferably a close fit in the opening in the fixing plate.

Again the "close fit" may be an interference fit but that is not particularly preferred and there may be a few mm of play.

The openings in the first and second connector blocks into which the spigot is inserted are preferably suitable for some of the openings in corner fittings for handling by ISO standard load handling equipment. Such load handling equipment is designed to engage corner castings of freight containers made in accordance with ISO/TC-104-1161. The first and second connector blocks may also be provided with further openings suitable for handling by ISO standard load handling equipment. As explained in more detail in WO 2005038155, the description of which is incorporated herein by reference, there are major transport benefits if the building modules are able to be handled and transported by standard freight container equipment, but that is not an essential feature of the present invention.

Preferably the load bearing fixing plate is compressed between the first and second building modules. Such compression may be provided by the weight of modules pressing down on the plate and/or by some additional fastening means. Thus the spigot may provide the lateral location and securing of the connector blocks and the additional fastening system may secure the blocks together along the axis of the spigot.

The first and second modules are preferably connected together by an additional fastener system. The additional fastener system preferably includes a fastener assembly extending through further openings in the first and second connector blocks. In an embodiment of the invention described below the further openings are not suitable for ISO freight container handling equipment. Preferably, the fastener assembly is able to be inserted into the first and second connector blocks after they have been connected together by the spigot. The connector blocks are preferably provided with open-ended slots to receive the fastener assembly. By incorporating these features, it is possible to assemble the building modules into a building relying only on the spigot connection and only thereafter to install the additional fastener assembly.

The fastener assembly is preferably arranged to draw the first and second connector blocks towards one another, compressing the load bearing fixing plate therebetween. In that case, further lateral fixing of the connector blocks to one another may be provided by friction forces between the engaging parts. The fastener assembly is preferably a screw-threaded assembly and may simply comprise a bolt and nut.

Preferably the first and second building modules are of generally cuboidal shape and are connected together by the connecting system at each of four corner locations.

The load bearing fixing plate may be loaded in various ways. For example, it may project outwardly from the building modules and form a supporting ledge to which a cladding or other building component can be secured, or it may provide a wide cantilevered support which may for example provide the support for a balcony or a cantilevered walkway. In the most common case, however, the fixing plate is used to connect the first and second modules to other modules of the building; thus the building may include third and fourth building modules connected together and to the first and second modules by the connector system, each of the third and fourth building modules being hollow and defining a space of a size suitable for occupation by a person, the connector system further including a third connector block fixed to the third building module and a fourth connector block fixed to the fourth building module, the load bearing fixing plate being interposed between the third and fourth building modules, the connector system further including a further spigot that passes through a further opening in the fixing plate, projecting on one side of the plate into an opening in the third connector block and projecting on the opposite side of the plate into an opening in the fourth connector block.

As will be understood, the third and fourth modules may be the same or similar to the first and second modules and, similarly the third and fourth connector blocks and the further spigot may have one or more of the features specified above in respect of the first and second connector blocks and the spigot projecting into the first and second connector blocks.

The form of the fixing plate may be varied to vary the positioning of the first and second connector blocks relative to the third and fourth connector blocks. For example, the fixing plate may be arranged such that the first and second connector blocks are adjacent to the third and fourth connector blocks, or it may be arranged such that the first and second connector blocks are spaced from the third and fourth connector blocks with the fixing plate spanning the space. The portion of the fixing plate spanning the space may be in the form of a lamellar element but it may also be in the form of an element having some depth, for example in the form of a beam. In such a case the fixing plate may, for example, provide support for a corridor. Usually, but not necessarily, the first and second modules will be connected to the third and fourth modules at two spaced locations at each of which four connector blocks are fixed together. Usually the same fixing plate would be used at both locations to provide the same separation between the building modules at each location, but it is possible to use different fixing plates and thereby create an angle between the first and second building modules on the one hand and the third and fourth building modules on the other hand. In that way the modules may be arranged around a curve or even a complete circle.

Preferably the second building module is disposed above the first building module and the fourth building module is disposed above the third building module. The first, second, third and fourth building modules are preferably of generally cuboidal shape having a pair of opposite ends, a pair of opposite sides, a top and a bottom. The ends being shorter than the sides. There are advantages in a building module being the width of a standard freight container and therefore having a width of about 8 ft (2,438 mm); such a module is especially easy to transport. It is however generally preferable for a building module to be of greater width and the modules are preferably each of a width greater than 2,700 mm and preferably in the range of 2,700 to 5,000 mm. The length of the modules may advantageously match one of the standard lengths of a freight container. Those lengths include 20 ft (6,058 mm), 30 ft (9,144 mm), 40 ft (12,192 mm) and 45 ft (13,716 mm) and up to (or even above) 53 ft (16,154 mm). The overall length of each module is therefore preferably in the range of 6,058 mm to 16,154 mm.

The first and second connector blocks, and the third and fourth connector blocks, when provided, are preferably disposed at respective corners of the building modules. Connector blocks may be provided alternatively or additionally along edges of the modules away from the corners. The load bearing fixing plate may project laterally outwardly from the sides of the first and second building modules or it may project longitudinally outwardly from the ends of the first and second building modules, according to the particular design of building and positioning on the modules of the connector blocks.

Where reference is made herein to a connector block, it should be understood that whilst it will usually be preferable to provide a single discrete component of a block, for example as a casting, and then fix it to the module, for example by welding, it is within the scope of the invention for the block to be formed partly as a casting and partly as a fabrication, or part or all of the block may be formed as an integral part of the rest of the structure of the module rather than as a separate block.

Whilst in many cases it is envisaged that an outwardly projecting portion of the fixing plate will be of a lamellar form, it may take any of a wide variety of forms and some of those are described below with reference to the accompanying drawings. For example the fixing plate may project outwardly from the connector blocks and may provide a substantially horizontal ledge for supporting a load. The ledge may be provided at the same level as the interface of the connector blocks or the fixing plate may be stepped to provide a ledge offset from the interface. In another embodiment, the fixing plate may project outwardly from the connector blocks and provide a substantially vertical plate for supporting a load. The load may be fixed to the plate by fasteners, for example bolts, or by welding. In another embodiment the fixing plate projects outwardly from the connector blocks to form a cantilever for supporting a load; in this case, the fixing plate may also project inwardly to increase the load that can be applied to the outer end of the plate without damaging the modules. The outwardly projecting portion of the fixing plate may be in the form of a beam.

As described in more detail in WO 2005038155, the components of the building may be manufactured far from the final location of the building. This invention also relates to the components prior to their assembly into a building. Thus the invention provides a plurality of building modules including a connector system, the modules and system being suitable for assembly into a building as defined above.

The present invention also provides a connector system for connecting modules together, the connector system comprising a first block fixed to the first module, a second block fixed to the second module, a load bearing fixing plate interposed between the first and second modules and projecting outwardly therefrom and a spigot that passes through an opening in the fixing plate, projecting on one side of the plate into an opening in the first block and projecting on the opposite side of the plate into an opening in the second block.

The connector system may be employed to connect together modules to form a building structure such as a hotel, a prison, student accommodation, a set of apartments, houses, or a car park, or it may be employed to form a different kind of structure.

The connector system may also have any of the other features described above.

According to the invention there is still further provided a method of constructing a building including the steps of:

providing first and second building modules, each of the first and second building modules being hollow and defining a space of a size suitable for occupation by a person, providing a connector system comprising a first connector block fixed to the first building module in the region of a top edge of the module, a second connector block fixed to the second building module in the region of a bottom edge of the module, a load bearing fixing plate and a spigot, inserting an end of the spigot into an opening in the top of the first connector block.

The building formed by the method of the invention may include any of the features of the building defined above. Thus the method may include features that give rise to any of the building features described above.

By way of example, an embodiment of the invention will now be described with reference to the accompanying drawings, of which:

Figure 1:
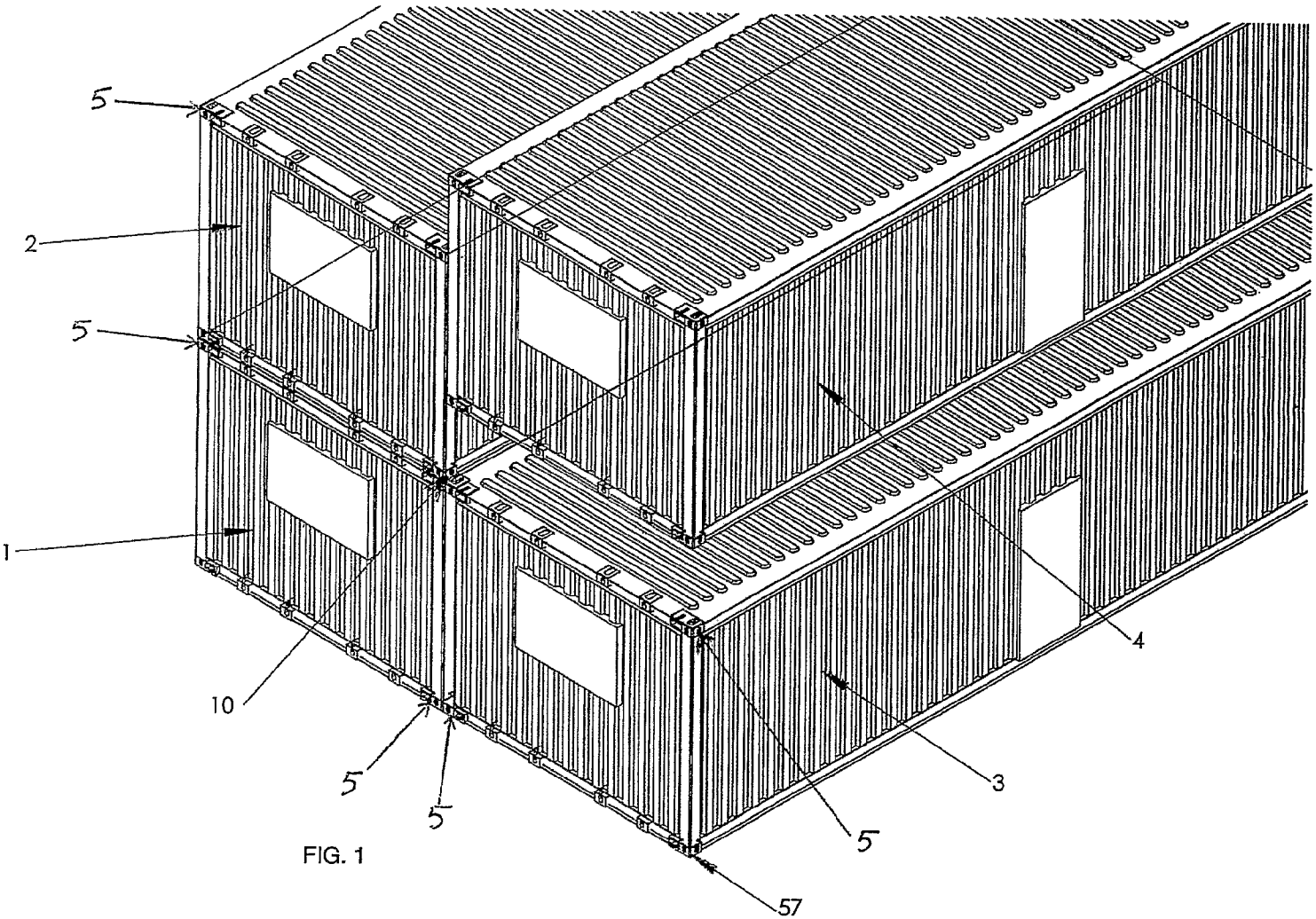
FIG. 1 is an isometric view of four building modules being assembled to form part of a building.

Referring first to FIG. 1, there is a first lower building module 1, a second upper building module 2, a third lower building module 3 alongside the first lower module 1 and a fourth upper building module 4 which is shown in FIG. 1 being lowered into position on top of the third building module 3.

Each of the building modules 1, 2, 3, 4 is of cuboidal shape and may be fitted with one or more windows, doors or other openings as more fully described in WO 2005038155. At the corner of each module a respective hollow connector block 5 is provided so that each module has eight connector blocks. The connector blocks 5 are welded to elongate structural members of each module. As will be understood, in FIG. 1 the rear ends of the modules are not shown but the arrangement at the rear ends of the modules is the same as at the front ends.

Figure 2:
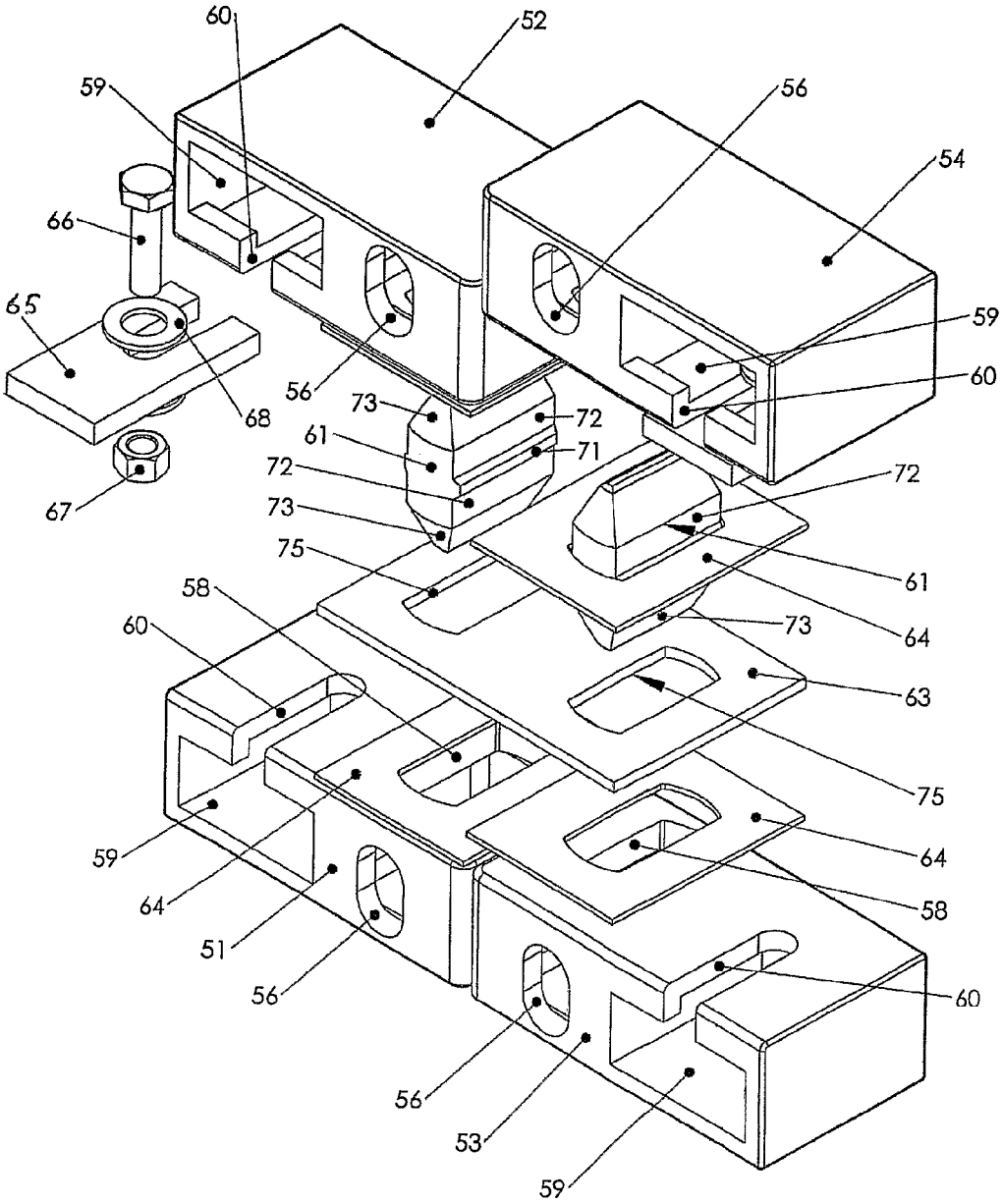
FIG. 2 is an exploded view of a connector system for connecting together the modules.
Figure 3:
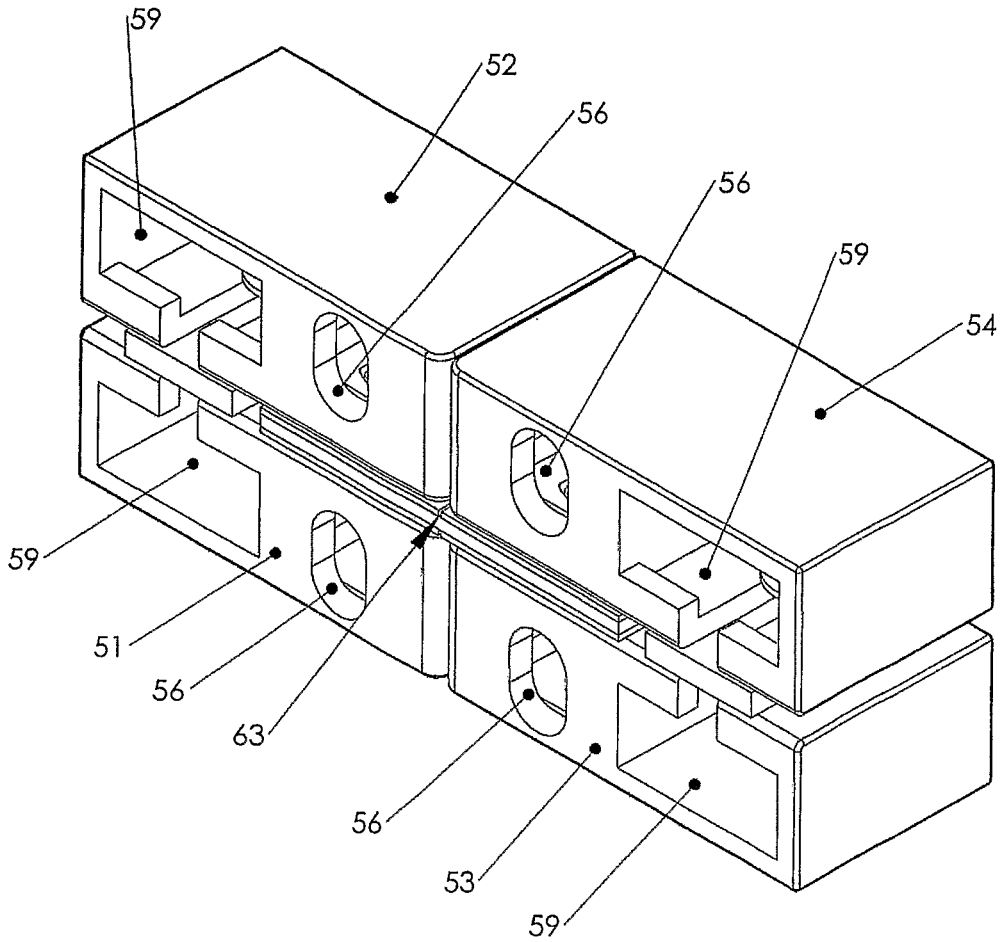
FIG. 3 is an isometric view of the connector system connecting together the four modules at one location.

FIGS. 2 and 3 showed the connector blocks 5 that are in the region indicated by the arrow 10 in FIG. 1. In FIGS. 2 and 3, numeral 51 designates the connector block at the top right corner of the module 1, numeral 52 designates the connector block at the bottom right corner of the module 2, numeral 53 designates the connector block at the top left corner of the module 3 and numeral 54 designates the connector block at the bottom left corner of the module 4, all references to left and right being as seen in FIG. 1.

The connector blocks, 51, 52, 53, 54 comprise part of a connector system that also comprises two spigots 61, a fixing plate 63, gaskets 64 and an additional fastener system including a plate 65, a bolt 66, a nut 67 and a washer 68. In FIGS. 2 and 3, some of the components are shown only in one of the Figures and/or only on one of the connector blocks. For example, in FIG. 2 only one fastening system is shown associated with the connector blocks 51 and 52, but it should be understood that another fastening system is associated with the connector blocks 53, 54.

As can readily be seen from the drawings, the connector blocks 51, 52, 53, 54 are all of substantially the same design but have left, right, top and bottom versions according to the corner of the building module to which they are welded. Each connector block has an opening 56 in a front face which is dimensioned as for an ISO corner casting of a freight container. Similarly each connector block has an opening 57 in an exterior side face (most of the openings 57 are not visible in any of the drawings but some are visible in FIG. 1) which is also dimensioned as for an ISO corner casting. Finally, each connector block has a third opening 58 in an exterior top or bottom face (the openings 58 in the blocks 51 and 53 being marked in FIG. 2) which again is dimensioned as for an ISO corner casting. Unlike a standard corner casting of a freight container, however, each connector block also has an additional opening 59 in its front face and a slot 60 in its exterior top or bottom face for receiving the fastening system as described below.

The two spigots 61 are each symmetrical about a widest middle portion 71 and extend in both opposite directions from that middle portion along a first portion 72 of substantially constant cross-section and then a second portion 73 that tapers smoothly to a rounded end.

The operation of the connector system will now be described. The lower modules 1 and 3 are first placed on the ground alongside one another with the connector blocks 51, 53 therefore in the position shown in FIG. 3 but with the blocks 52, 54 absent. Gaskets 64 are then placed over the openings 58 in the tops of the blocks 51, 53 and the lower ends of the spigots 61 inserted into the openings 58, with the result that the first portions 72 of the lower ends of the spigots are received as a close fit in the openings 58.

The fixing plate 63 is then fitted over the upper ends of the spigots and rests on top of the gaskets 64. The fixing plate 63 has two apertures 75 in which the widest middle portion 71 of the spigots 61 are received as a close fit. The fixing plate 63 is made of relatively thick high strength steel and provides the connection between the modules 1 and 3 (and as will be explained below, the connection between the modules 2 and 4).

Further gaskets 64 are then placed over the upper ends of the spigots 61 and the modules 52 and 54 lowered in turn on to the modules 51 and 53 respectively. As the module is lowered, the upper tapered end of the spigot 61 enters the opening 58 in the bottom of the connector block being lowered and any slight misalignment of the connector block and the spigot 61 is corrected. At the end of the lowering of the modules, the connector blocks are in the positions shown in FIG. 3 with the first portions 72 of the upper ends of the spigot closely fitting in the openings 58 in the bottoms of the connector blocks 52, 54. Thus a precise positioning of the corners of each module is achieved.

It should be understood that in a typical case where the upper module is of the same size in plan as the module it overlies, it may be desired to provide a connection of the kind just described at each corner of the module. In that case, all the spigots, gaskets and fixing plates associated with a lower module must be brought into position before the upper module is placed on top of the lower module.

In the state of assembly described to this point, the modules in a lower tier are held in position by the modules above. Such a purely gravitational fastening will often not be sufficient and the fastener system is provided as an additional fastening. Once the modules have been assembled as described above, the fastener system can be installed: the bolt 66 and washer 68 can be slid into the groves 60 in the connector blocks, with the head of the bolt 66 and the washer 68 pressing through the opening 59 in the upper block and the nut 67, threaded loosely on the end of the bolt 66, passing through the opening 59 in the lower block.

The spacer plate 65 can then be inserted between the upper and lower connector blocks with a groove in the plate 65 accommodating the shaft of the bolt 66. Once in position the nut 67 can be tightened, drawing the upper and lower connector blocks together with the spacer plate 65 and the fixing plate 63 being compressed between the blocks. When so tightened, the bolt and nut, together with gravity, prevent movement of the connector blocks away from each other in a vertical direction, and the spigots 61 prevent any relative lateral movement. In that way a very strong and secure coupling of modules can be achieved in a simple manner.

The fixing plate may be altered to alter the relative positions of the modules. For example, if the fixing plate were longer and the apertures 75 in the fixing plate spaced further apart, a greater horizontal separation of the modules could be obtained. By adopting a greater spacing of the modules at one end than at the other, a deliberate inclination of one module to another can be created, allowing the modules to extend around a curved path, if desired.

In the drawings, the fixing plate 63 is shown as not projecting from the connector blocks 5. In many applications that will be the desired arrangement but it is also possible to arrange for the fixing plate to project outwardly from the modules. If desired, for example to provide a strong cantilever, the fixing plate may also extend inwardly from the connector blocks. Accordingly the fixing plate may be extended to provide structural members that may for example form bridges between modules, cantilevered balconies or walkways, or other structures. In this respect it should be understood that the fixing plate need not be of a lamellar construction away from the interface of the modules and even at the interface it may have a vertical section that extends downwardly between modules. Thus the fixing plate may also form an I beam or the like, or indeed some other structural shape.

FIGS. 4A to 8B show some of the possible forms that the fixing plate may take. In those Figures, the connector blocks and additional fastener system are the same as for the blocks 5 shown in FIGS. 1 to 3 and the same reference numerals are used to designate corresponding parts, but in the interests of clarity only some reference numerals are shown. As in FIGS. 1 to 3, some parts are also omitted from the drawings in the interests of clarity.

Figure 4B:
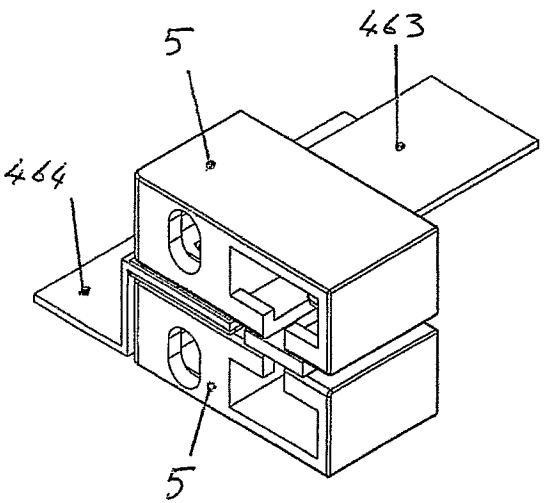
FIG. 4B is an isometric view of the connector system of FIG. 4A.
Figure 4A:
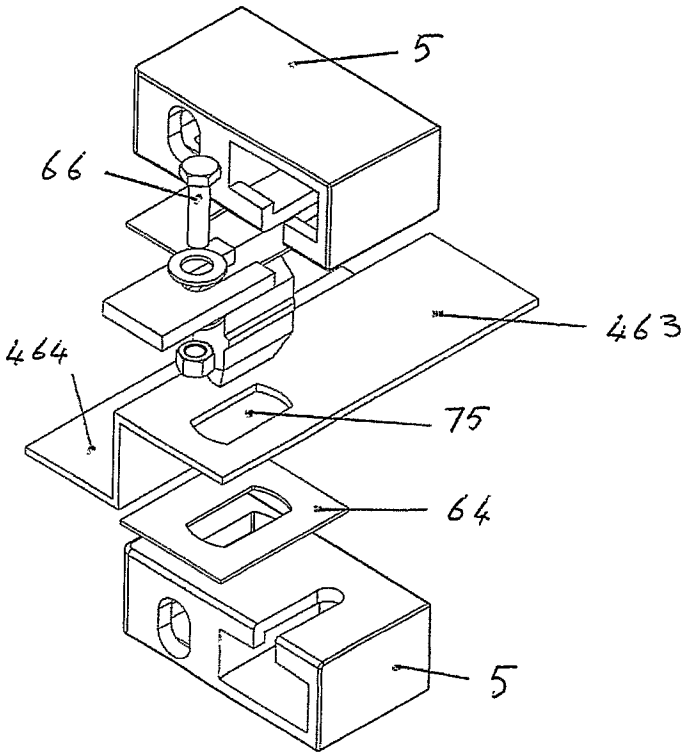
FIG. 4A is an exploded view of another form of connector system for connecting the modules together.

In FIGS. 4A and 4B, a fixing plate 463 is shown formed with a horizontal ledge 464 at a lower level than the interface of the connector blocks. The ledge can, for example, be used to support brick cladding. In FIGS. 4A and 4B, the fixing plate is shown extending a short distance rearwardly from the connector blocks; if desired the fixing plate may extend along the whole length of a module to a similar pair of connector blocks at the other end of the module.

Figure 5B:
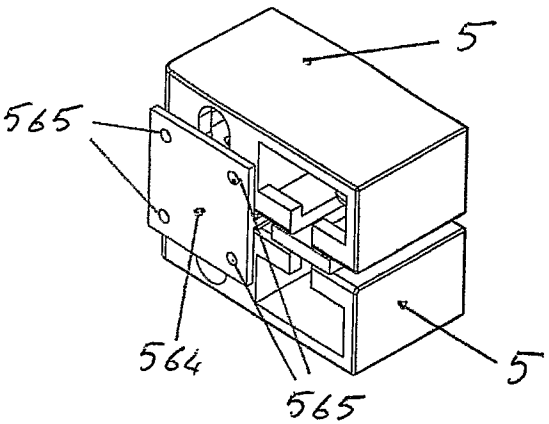
FIG. 5B is an isometric view of the connector system of FIG. 5A.
Figure 5A:
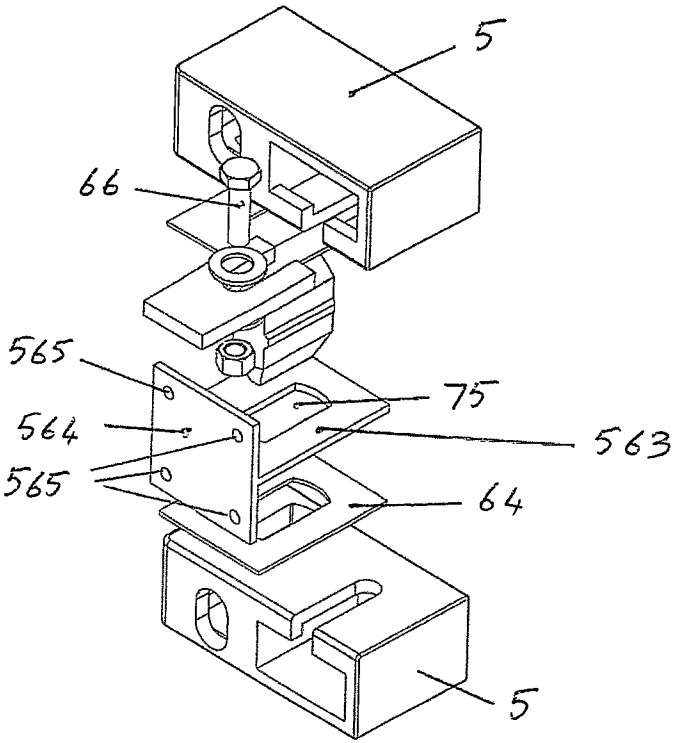
FIG. 5A is an exploded view of yet another form of connector system for connecting the modules together.

In FIGS. 5A and 5B, a fixing plate 563 is shown formed with a vertical plate 564 of a square shape provided in this example with four holes 565 which may for example receive nut and bolt fasteners to secure, for example, a wall cladding to the modules.

Figure 6B:
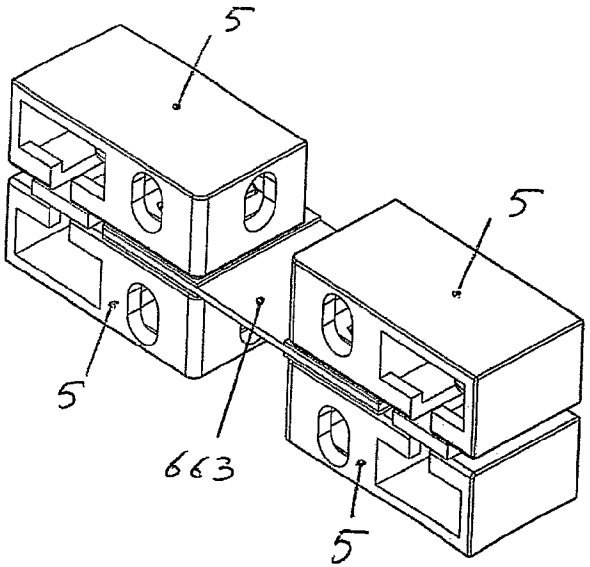
FIG. 6B is an isometric view of the connector system of FIG. 6A.
Figure 6A:
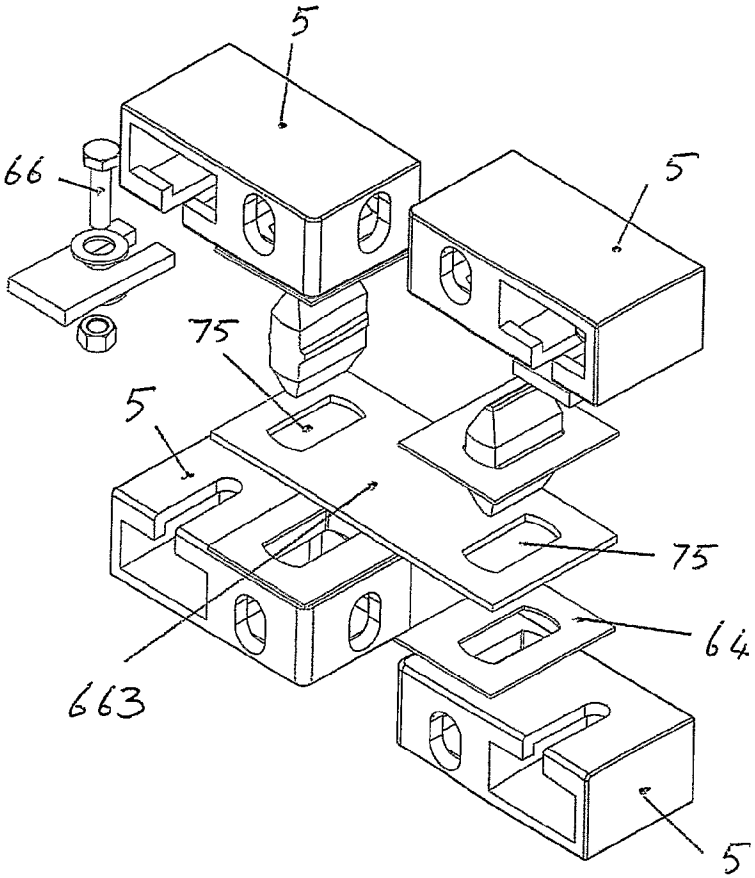
FIG. 6A is an exploded view of yet another form of connector system for connecting the modules together.

In FIGS. 6A and 6B, a fixing plate 663 is shown which is larger than the fixing plate 63 shown in FIGS. 2 and 3 and which can be used to connect together modules at a spacing from one another.

Figure 7A:
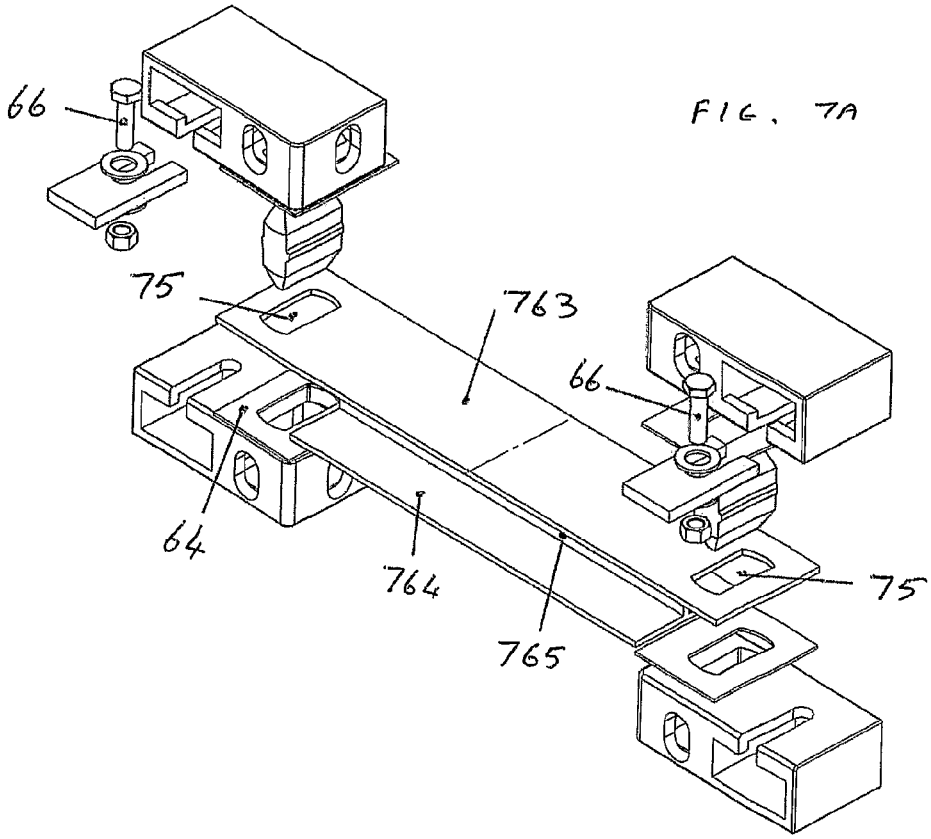
FIG. 7A is an exploded view of yet another form of connector system for connecting the modules together.
Figure 7B:
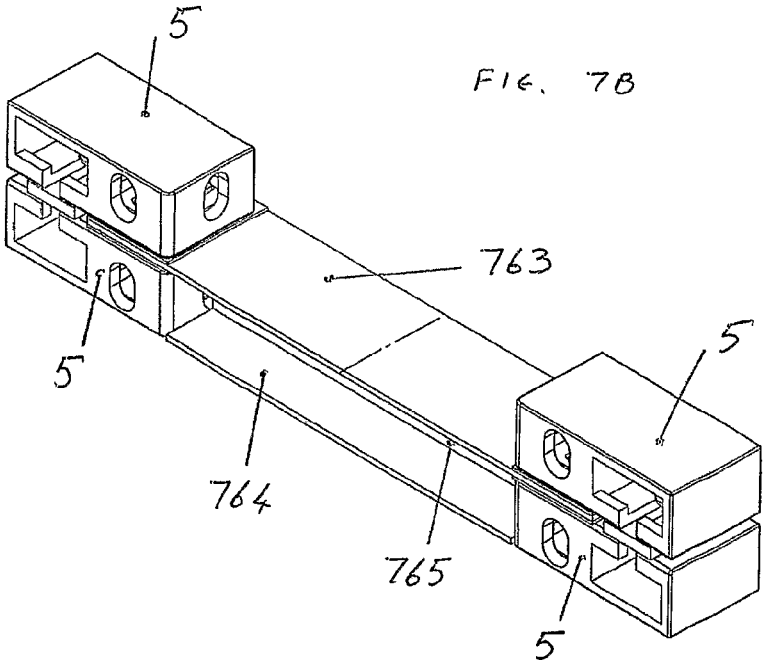
FIG. 7B is an isometric view of the connector system of FIG. 7A.

In FIGS. 7A and 7B, a fixing plate 763 is shown which is much larger than the fixing plate 663 and can be used to connect together modules with a substantial space between them, for example to allow a corridor to be supported between the modules. The portion of the fixing plate 763 between the modules is in the form of an I beam including a lower part 764 and a vertical central part 765.

Figure 8A:
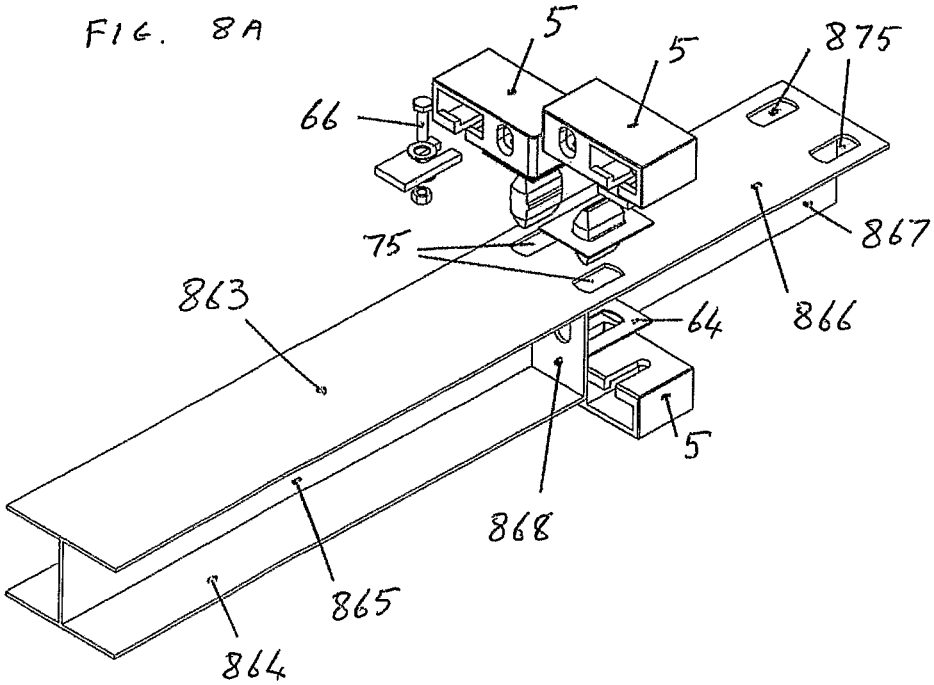
FIG. 8A is an exploded view of yet another form of connector system for connecting the modules together.
Figure 8B:
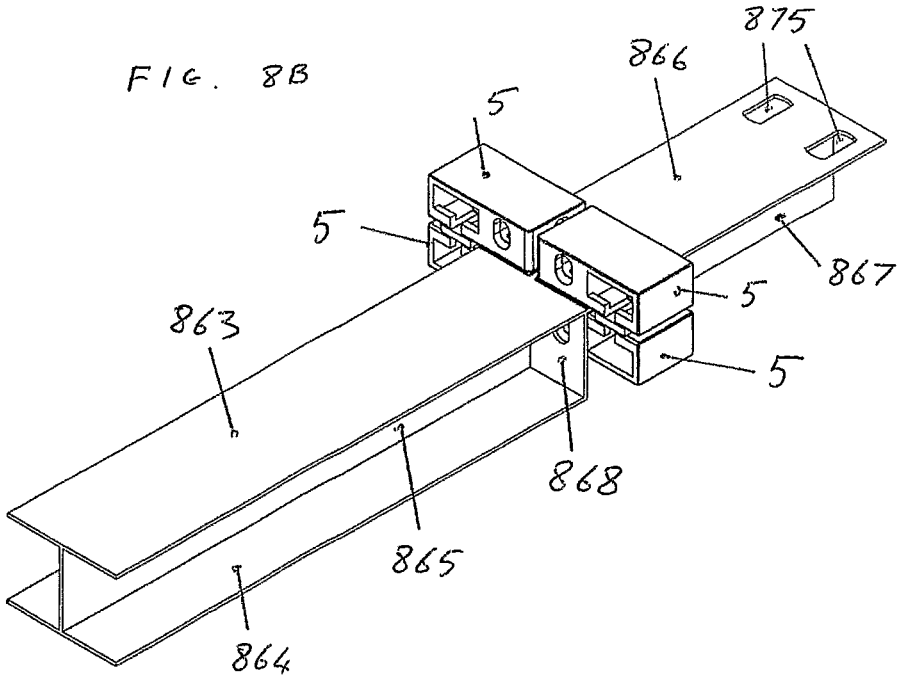
FIG. 8B is an isometric view of the connector system of FIG. 8A.

In FIGS. 8A and 8B, a fixing plate 863 is shown. This plate includes an outwardly projecting portion in the form of an I beam including a lower part 864 and a vertical part 865. In this example the inner end of the vertically projecting beam also has an end wall 868 with openings to allow access to the openings in the connector blocks. The fixing plate 863 also extends inwardly having a horizontal inwardly projecting part 866 and a strengthening vertical part 867. The parts 866 and 867 are accommodated in the gaps between adjacent modules. In the particular example shown there are a pair of further openings 875 at the inner end of the fixing plate for receiving spigots that engage in further connector blocks (not shown). Such further spigots and connector blocks may, for example, be provided when the module has a length of 45 ft (13,716 mm) and further connector blocks are provided at a spacing of a 40 ft (12,192 mm) module.

In the drawings the connector blocks 5 are shown welded to building modules at the corners of the modules and with their longitudinal axis extending transverse to the longitudinal axis of the modules. Another possibility is for the longitudinal axis of the connector blocks to be arranged with their longitudinal axis extending parallel to the longitudinal axis of the modules and/or to be provided midway along side or end edges of the modules. Other fastening elements may also be provided along the edges of the modules as described in more detail in WO 2005038155.

The connector blocks shown in the drawings are all located around the outside of the assembly of building modules, but for large buildings some connector blocks will be located within the building and their sides will not be accessible. Such blocks can still be connected using the spigots 61 but a different form of additional fastener system is required if any additional system is used. It may be sufficient to have the additional fastener systems preventing lifting of the modules only around the external sides of a structure, but if that is not sufficient a screw threaded fastener, such as a bolt, extending downwardly from an upper connector block and engaging a screw threaded recess in a lower connector block may be employed, from the inside of the module.

Each of the connector blocks 5 shown in FIG. 1 is formed in one piece as a casting, but it may also be made in other ways. For example, the block 5 may be formed as a casting that is the same as, or similar to, a standard freight container corner casting in accordance with ISO/TC-104-1161 to which a fabrication of sheet steel is welded. In that case the casting would correspond to the right hand portion of the connector block 51 as seen in FIGS. 2 and 3, while the fabrication would correspond to the left hand portion of the same connector block 51. Another possibility would be to form the right hand portion (as seen in FIGS. 2 and 3) of the connector block 51 as a separate component and then weld it to the left hand portion, or to provide the right hand portion as a separate component spaced from the left hand portion. Also the right hand portion, which provides the additional fastener system for drawing the modules together could even be provided away from the connector blocks, by fasteners passing through suitable openings in structural members of the modules. Where reference is made above to the connector blocks of FIGS. 2 and 3, it will be understood that substantially the same comments apply to the connector blocks of the connector systems of FIGS. 4A to 8B.

The invention claimed is:

1. A building including first and second building modules connected together by a connector system, each of the first and second building modules being hollow and defining a space of a size suitable for occupation by a person, the connector system comprising a first connector block fixed to the first building module, a second connector block fixed to the second building module, a load bearing fixing plate interposed between the first and second building modules and projecting outwardly therefrom, and a spigot that passes through an opening in the fixing plate, projecting on one side of the plate into an opening in the first connector block and projecting on the opposite side of the plate into an opening in the second connector block, wherein the first and second modules are connected together by an additional fastener system including a fastener assembly extending through further openings in the first and second connector blocks, the fastener assembly being arranged to draw the first and second connector blocks towards one another, compressing the load bearin fixing plate therebetween.

2. A building according to claim 1, in which the spigot has a relatively wide middle portion that passes through the opening in the fixing plate and reduces in cross-section towards each of its opposite ends.

3. A building according to claim 1, in which the portions of the spigot immediately inside the openings in the first and second connector blocks are of substantially constant cross-section.

4. A building according to claim 3, in which the portions of the spigot of substantially constant cross-section are close fits in the connector blocks.

5. A building according claim 1, in which the openings in the first and second connector blocks are openings sized and shaped to be suitable for some of the openings in corner fittings for handling by ISO standard load handling equipment.

6. A building according to claim 1, in which the fastener assembly is able to be inserted into the first and second connector blocks after they have been connected together by the spigot.

7. A building according to claim 1, in which the fastener assembly is a screw threaded assembly.

8. A building according to claim 1, in which the first and second building modules are of generally cuboidal shape and are connected together by the connecting system at each of four corner locations.

9. A building according to claim 1, including third and fourth building modules connected together and to the first and second modules by the connector system, each of the third and fourth building modules being hollow and defining a space of a size suitable for occupation by a person, the connector system further including a third connector block fixed to the third building module and a fourth connector block fixed to the fourth building module, the load bearing fixing plate being interposed between the third and fourth building modules, the connector system further including a further spigot that passes through a further opening in the fixing plate, projecting on one side of the plate into an opening in the third connector block and projecting on the opposite side of the plate into an opening in the fourth connector block.

10. A building according to claim 9, in which the third and fourth connector blocks and a further spigot have any one or more of the features specified in claim 2 in respect of the first and second connector blocks and the spigot projecting into the first and second connector blocks.

11. A building according to claim 9, in which the fixing plate is arranged such that the first and second connector blocks are adjacent to the third and fourth connector blocks.

12. A building according to claim 9, in which the fixing plate is arranged such that the first and second connector blocks are spaced from the third and fourth connector blocks with the fixing plate spanning the space.

13. A building according to claim 12, in which the portion of the fixing plate spanning the space is in the form of a beam.

14. A building according to claim 1, in which the second building module is disposed above the first building module and the fourth building module is disposed above the third building module.

15. A building according to claim 1, in which the first, second, third and fourth building modules are each of generally cuboidal shape having a pair of opposite ends, a pair of opposite sides, a top and a bottom, the ends being shorter than the sides.

16. A building according to claim 15, in which the first and second connector blocks are disposed at respective corners of the building modules.

17. A building according to claim 16, in which the load bearing fixing plate projects laterally outwardly from the sides of the first and second building modules.

18. A building according to claim 16, in which the load bearing fixing plate projects longitudinally outwardly from the ends of the first and second building modules.

19. A building according to claim 1, in which the fixing plate projects outwardly from the connector blocks and provides a substantially horizontal ledge for supporting a load.

20. A building according to claim 1, in which the fixing plate projects outwardly from the connector blocks and provides a substantially vertical plate for supporting a load.

21. A building according to claim 1, in which the'fixing plate projects outwardly from the connector blocks to form a cantilever for supporting a load.

22. A building according to claim 21, in which the outwardly projecting portion of the fixing plate is in the form of a beam.

23. A plurality of building modules including a connector system, the modules and system being suitable for assembly into a building according to claim 1.

24. A method of constructing a building including the steps of:

providing first and second building modules, each of the first and second building modules being hollow and defining a space of a size suitable for occupation by a person, providing a connector system comprising a first connector block fixed to the first building module in the region of a top edge of the module, a second connector block fixed to the second building module in the region of a bottom edge of the module, a load bearing fixing plate and a spigot, inserting an end of the spigot into an opening in the top of the first connector block, placing the loading bearing fixing plate over a part of the spigot projecting upwardly from the opening in the top of the first connector block, and placing the second building module on top of the first such that the upwardly projecting end of the spigot is inserted into an opening in the bottom of the second connector block, wherein the method includes the step of connecting the first and second modules together by an additional fastener system including a fastener assembly extending through further openings in the first and second connector blocks, the fastener assembly being arranged to draw the first and second connector blocks towards one another, compressing the load bearing fixing plate therebetween.

* * * * *